US011841173B2

(12) United States Patent
Li et al.

(10) Patent No.: US 11,841,173 B2
(45) Date of Patent: Dec. 12, 2023

(54) VARIABLE STAGE COMPRESSORS

(71) Applicant: Danfoss A/S, Nordborg (DK)

(72) Inventors: Tianlei Li, Tallahassee, FL (US); Zili Sun, Tallahassee, FL (US); Lin Sun, Tallahassee, FL (US)

(73) Assignee: Danfoss A/S

( * ) Notice: Subject to any disclaimer, the term of this patent is extended or adjusted under 35 U.S.C. 154(b) by 113 days.

(21) Appl. No.: 16/455,998

(22) Filed: Jun. 28, 2019

(65) Prior Publication Data

US 2020/0003455 A1 Jan. 2, 2020

Related U.S. Application Data

(60) Provisional application No. 62/691,083, filed on Jun. 28, 2018.

(51) Int. Cl.

| | |
|---|---|
| ***F04D 27/00*** | (2006.01) |
| ***F25B 1/053*** | (2006.01) |
| ***F04D 29/44*** | (2006.01) |

(52) U.S. Cl.

CPC ..... *F25B 1/053* (2013.01); *F04D 27/002* (2013.01); *F04D 29/441* (2013.01)

(58) Field of Classification Search

CPC .. F04D 27/002; F04D 27/005; F04D 27/0207; F04D 27/0246; F04D 27/0269; F04D 29/46; F04D 29/462; F04D 29/464; F04D 29/441; F04D 29/4206; F04D 29/622; F04D 17/12; F25B 1/053; F25B 1/10

See application file for complete search history.

(56) References Cited

U.S. PATENT DOCUMENTS

| | | | | | |
|---|---|---|---|---|---|
| 1,743,916 | A * | 1/1930 | Hargis | F04D 29/4286 | 415/128 |
| 2,927,536 | A * | 3/1960 | Merrill | F04D 15/0038 | 415/48 |
| 4,369,017 | A * | 1/1983 | Carlini | F04D 27/002 | 415/157 |
| 4,419,046 | A * | 12/1983 | Carlini | F01D 17/105 | 415/127 |
| 4,828,454 | A * | 5/1989 | Morris | F04D 15/0038 | 415/131 |
| 4,832,565 | A * | 5/1989 | Dussourd | F04D 29/047 | 384/901 |

(Continued)

FOREIGN PATENT DOCUMENTS

| | | | |
|---|---|---|---|
| FR | 2681906 | A1 | 4/1993 |
| JP | 62243997 | A | 10/1987 |

(Continued)

OTHER PUBLICATIONS

European Search Report for European Application No. 19183466.2 dated Nov. 20, 2019.

*Primary Examiner* — J. Todd Newton
*Assistant Examiner* — Wayne A Lambert
(74) *Attorney, Agent, or Firm* — Carlson, Gaskey & Olds, P.C.

(57) ABSTRACT

A centrifugal compressor includes a first stage and a second stage. At least one of the first stage and the second stage includes an impeller and a shroud spaced from the impeller and configured to guide a fluid flow through the impeller. The shroud is selectively moveable between an engaged position and a disengaged position.

18 Claims, 6 Drawing Sheets

(56) References Cited

U.S. PATENT DOCUMENTS

| | | | | |
|---|---|---|---|---|
| 4,929,150 | A * | 5/1990 | Daw | F04D 29/464 415/157 |
| 8,840,365 | B2 * | 9/2014 | Ervin | F02B 37/025 415/131 |
| 9,822,784 | B2 * | 11/2017 | Aiba | F04D 27/002 |
| 2014/0356138 | A1 * | 12/2014 | Sun | F04D 29/464 415/148 |
| 2016/0238012 | A1 * | 8/2016 | Nejedly | F04D 29/4213 |
| 2018/0038380 | A1 * | 2/2018 | Morgan | F04D 29/056 |
| 2018/0073779 | A1 * | 3/2018 | Johnson | F04D 27/004 |

FOREIGN PATENT DOCUMENTS

| | | | |
|---|---|---|---|
| WO | 8706981 | A | 11/1987 |
| WO | 2009056987 | A2 | 5/2009 |
| WO | 2017059219 | A1 | 4/2017 |

* cited by examiner

VARIABLE STAGE COMPRESSORS

This application claims priority to U.S. Provisional Application No. 62/691,083, filed Jun. 28, 2018.

BACKGROUND

Refrigerant compressors are used to circulate refrigerant in a chiller or heat pump via a refrigerant loop. Refrigerant loops are known to include a condenser, an expansion device, and an evaporator.

This disclosure relates to multi-stage centrifugal compressors, having at least one stage in which a shroud is selectively moveable between an engaged position and a disengaged position.

SUMMARY

A centrifugal compressor according to an example of this disclosure includes a first stage and a second stage. At least one of the first stage and the second stage includes an impeller and a shroud spaced from the impeller and configured to guide a fluid flow through the impeller. The shroud is selectively moveable between an engaged position and a disengaged position.

In a further example of the foregoing, the impeller is rotatbable about an axis, and the shroud is selectively moveable in the axial direction relative to the axis between the engaged position and the disengaged position.

In a further example of the foregoing, the impeller is rotatbable about an axis, and the shroud is selectively moveable in the radial direction relative to the axis between the engaged position and the disengaged position.

In a further example of any of the foregoing, a control system is configured to move the shroud between the engaged position and the disengaged position.

In a further example of any of the foregoing, the outer surface of the shroud forms a convex surface.

A method of compressing a refrigerant in a centrifugal compressor according to an example of this disclosure includes determining an efficiency of a first stage of a compressor and an efficiency of a second stage of a compressor. The example method includes disengaging one of the first stage and the second stage based on the determining by moving a shroud away from an impeller.

In a further example of the foregoing, the centrifugal compressor is a two-stage centrifugal compressor.

In a further example of any of the foregoing, the impeller is rotatable about an axis, and the disengaging includes moving the shroud in an axial direction relative to the axis.

In a further example of any of the foregoing, the method includes engaging the one of the first stage and the second stage based on the determining by moving the shroud in a second axial direction opposite the axial direction.

A refrigerant cooling system according to an example of this disclosure includes a main refrigerant loop in communication with a compressor, a condenser, an evaporator, and an expansion device. The compressor includes a first and second stage. At least one of the first stage and the second stage include an impeller and a shroud spaced from the impeller and configured to guide a fluid flow through the impeller. The shroud is selectively moveable between an engaged position and a disengaged position.

In a further example of the foregoing, the impeller is rotatbable about an axis, and the shroud is selectively moveable in the axial direction relative to the axis between the engaged position and the disengaged position.

In a further example of any of the foregoing, a control system is configured to move the shroud between the engaged position and the disengaged position.

In a further example of any of the foregoing, the outer surface of the shroud forms a convex surface.

These and other features may be best understood from the following specification and drawings, the following of which is a brief description.

DETAILED DESCRIPTION

Figure 1:
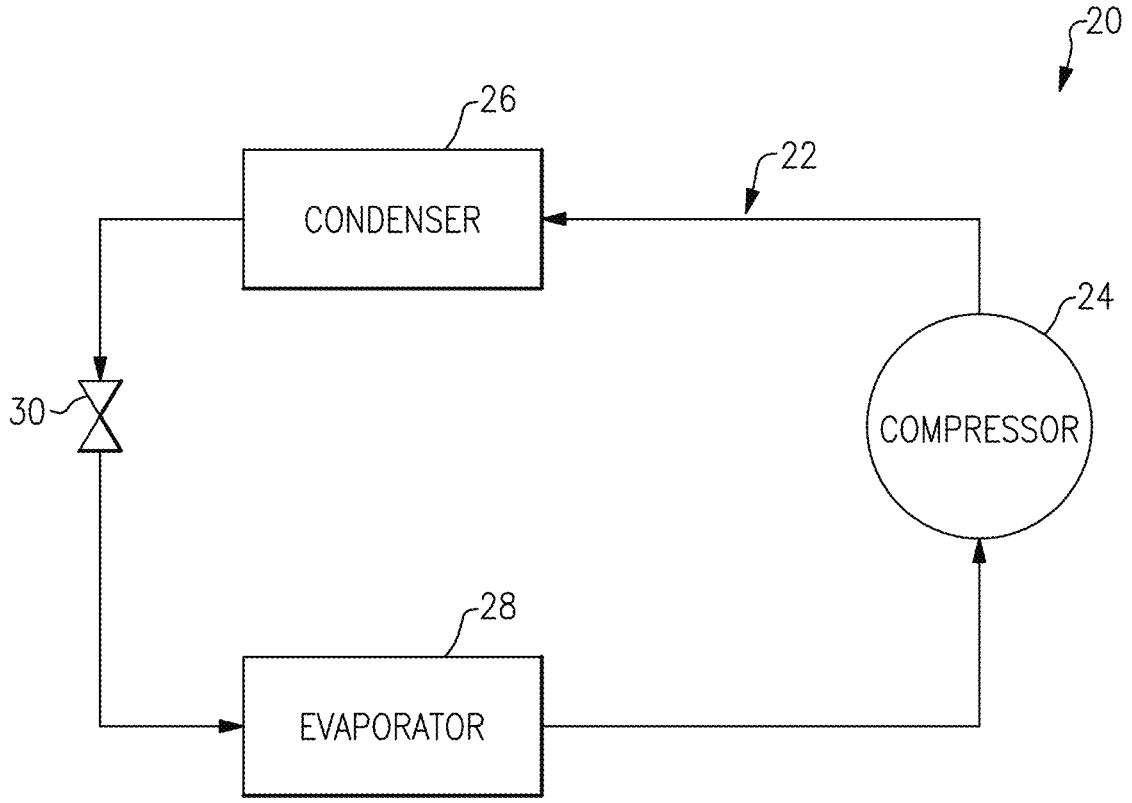
FIG. 1 is a schematic illustration of a refrigerant loop.

FIG. 1 schematically illustrates a refrigerant cooling system 20. The refrigerant system 20 includes a main refrigerant loop, or circuit, 22 in communication with a compressor or multiple compressors 24, a condenser 26, an evaporator 28, and an expansion device 30. This refrigerant system 20 may be used in a chiller or heat pump, for example.

Notably, while a particular example of the refrigerant system 20 is shown, this application extends to other refrigerant system configurations. For instance, the main refrigerant loop 22 can include an economizer downstream of the condenser 26 and upstream of the expansion device 30.

Figure 2:
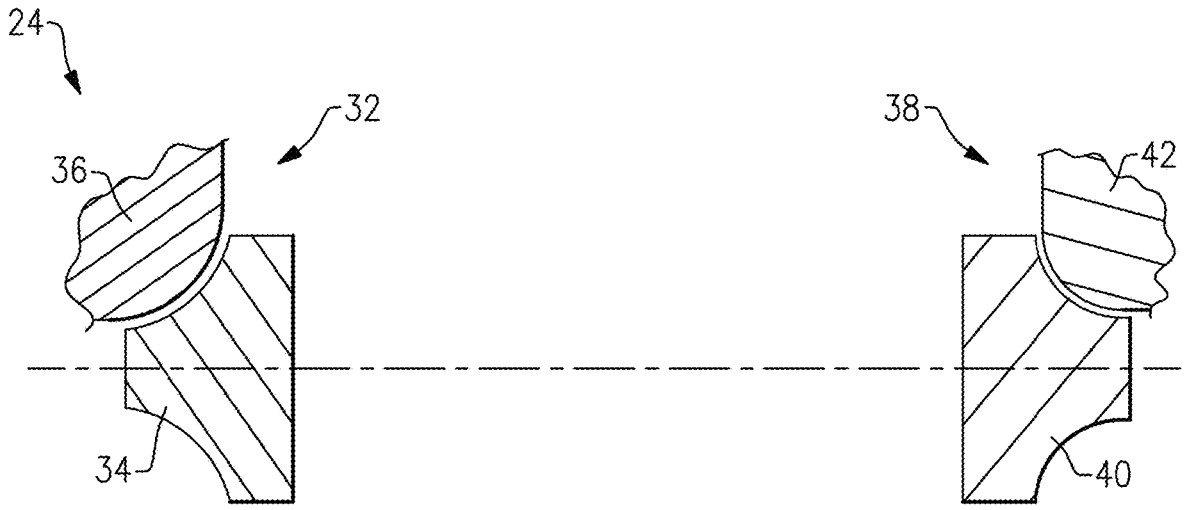
FIG. 2 schematically illustrates a cross section of an example compressor.

FIG. 2 schematically illustrates a cross section of an example compressor 24. The example compressor 24 is a two-stage compressor. A first stage 32 includes an impeller 34 and a shroud 36 (a portion of which is shown for viewing purposes) for guiding fluid through the impeller 34 and preventing flow crossing from one side of the blade of the impeller 34 to the other side through the gap between the impeller and the stationary shroud.

A second stage 38 includes an impeller 40 and a shroud 42 (a portion of which is shown for viewing purposes) for guiding fluid through the impeller 40. The example impellers 34, 40 are open-type impellers, but other impellers may be used in other embodiments. The example compressor 24 is a two stage centrifugal compressor. Other multiple-stage compressors may be utilized in other embodiments. In some embodiments, one stage includes an impeller and shroud arrangement, and another stage includes an alternative arrangement.

Figure 3:
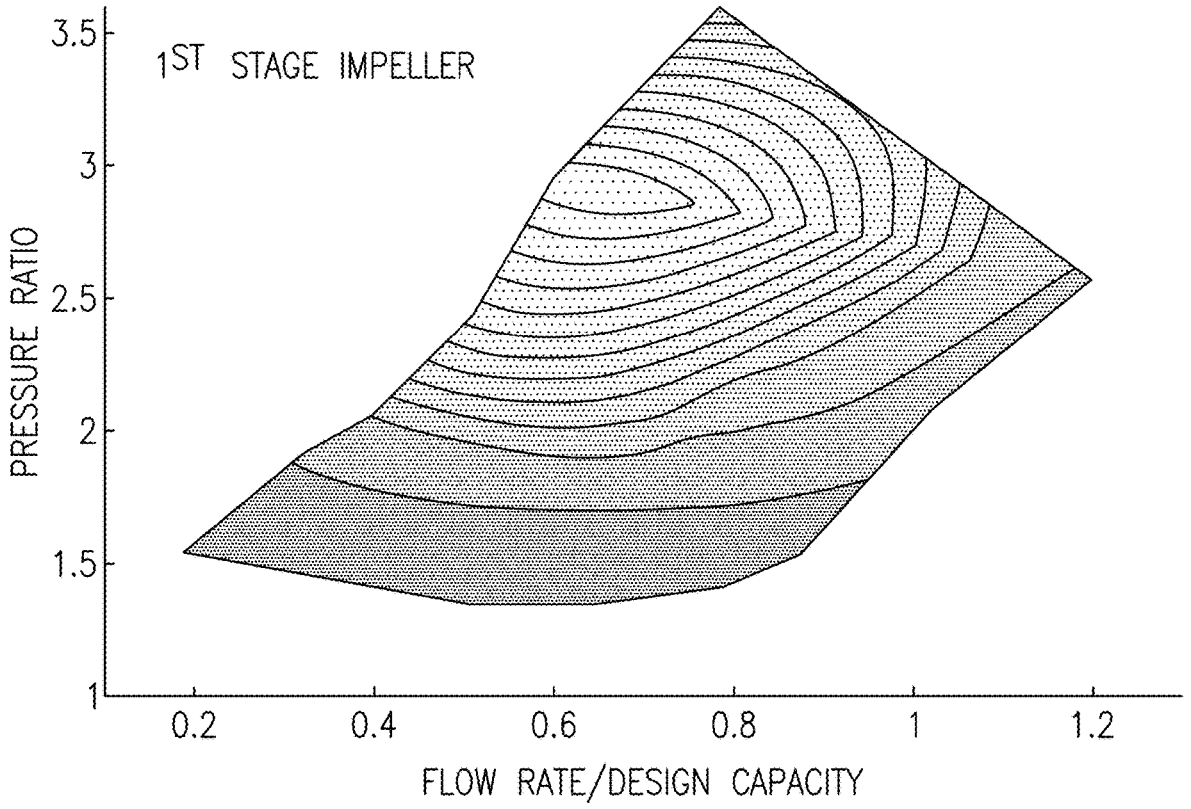
FIG. 3 illustrates an example efficiency map of a first impeller.
Figure 4:
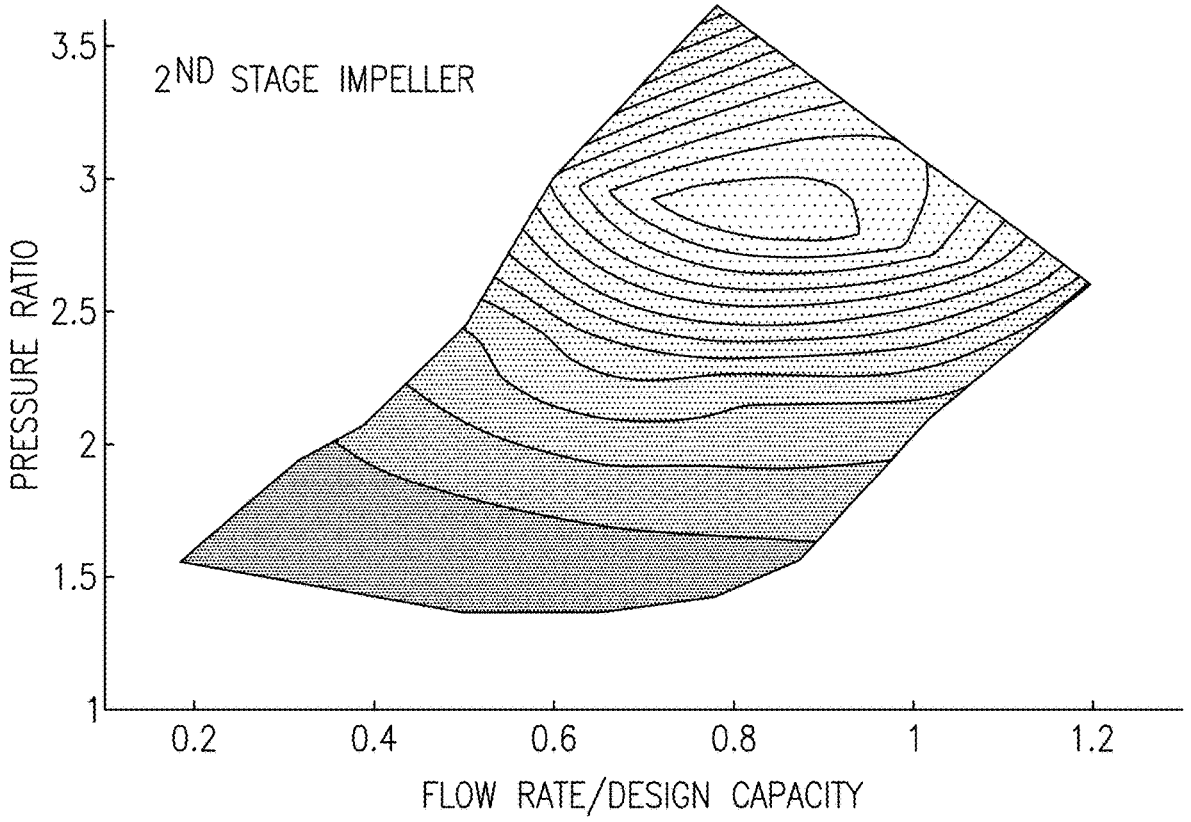
FIG. 4 illustrates an example efficiency map of a second impeller.

FIG. 3 illustrates an efficiency map for a first stage impeller 34. FIG. 4 illustrates an efficiency map for a second stage impeller 40. For a multiple stage compressor, the overall efficiency map and operating range are a combination of each individual compression stage and the interaction among them. The example stages 32, 38 have energy input at the same operating speed, which may lead to the individual stages operating at low efficiency points at some operating points. For example, when the two stages 32, 38 are working in the same time, assuming the total pressure ratio is 3 and the flow rate is 80% of the total flow, both impellers 34, 40 would have to run at a pressure ratio of 1.73, resulting in a first stage impeller 34 running at 47% efficiency and a second stage impeller 40 running at 26% efficiency. If the compressor 24 were to run with only the first stage impeller 34 at the same operating point, the compressor 24 would run at 78% efficiency and therefore be more efficient.

Figure 5:
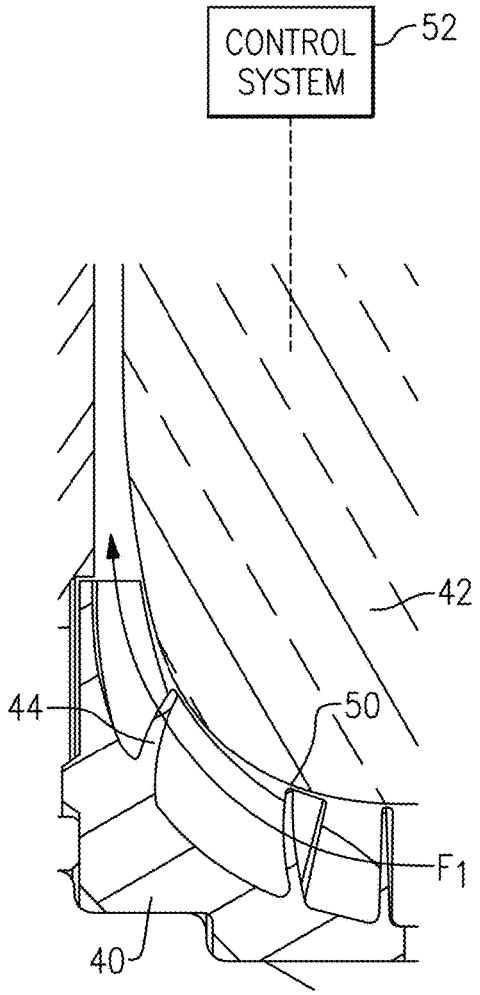
FIG. 5 illustrates a portion of an example second stage in an engaged position.

FIG. 5 illustrates a portion of an example impeller 40 and shroud 42 of the second stage 38 in an engaged position. The shroud 42 is positioned proximal to the radially outer edges 50 of the blades 44 of the impeller 42 to guide refrigerant flowing along the flow path $F_1$ through the blades 44. In the engaged position shown, the second stage 38 is engaged such that the impeller 40 provides work on the refrigerant. In some examples, as shown, the shroud 42 provides a convex outer surface that faces the blades 44.

Figure 6:
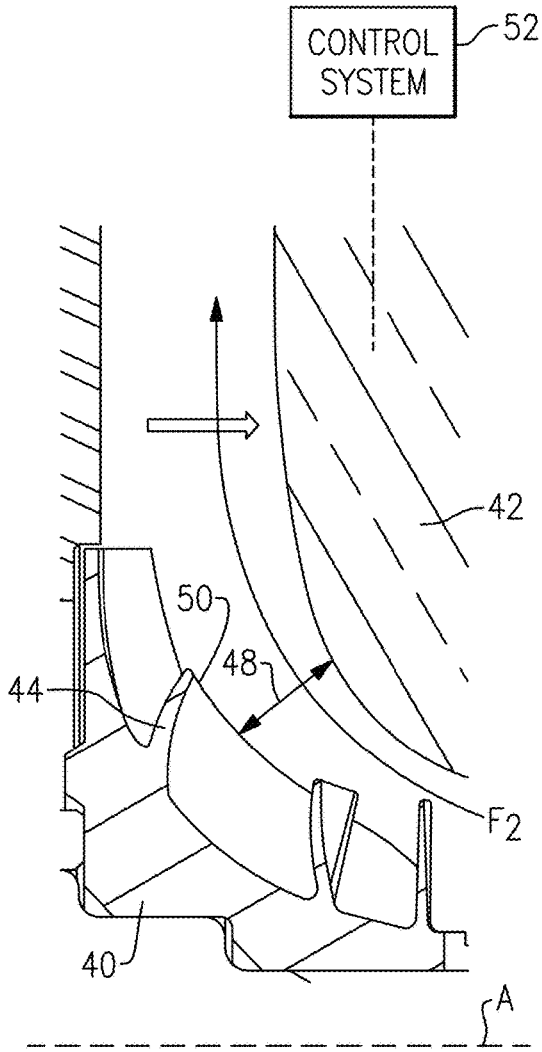
FIG. 6 illustrates a portion of the example second stage of FIG. 5 in a disengaged position.

FIG. 6 illustrates a portion of the example impeller 40 and shroud 42 of the second stage 38 in a disengaged position. The shroud 42 is moved away from the impeller 40 to create a gap 48 between the radially outer edges 50 of the blades 44 and the shroud 42. The refrigerant is then able to bypass the impeller 40 by flowing through the gap 48 along the fluid path $F_2$. That is, the shroud 42 is selectively moveable to the disengaged position. In the embodiment shown, the shroud 42 is moved in the axial direction relative to the rotational axis A to create the gap 48, but the shroud 42 may be moved in other directions, such as radially in some embodiments, to create a gap between the shroud and the blades. In some examples, the gap 48 may increase from 0-2 mm in the engaged position to 2-50 mm in the disengaged position. In the disengaged position shown, the impeller 40 does a reduced amount of work on the refrigerant as compared to the engaged position shown in FIG. 5.

Although the embodiment shown in FIGS. 5 and 6 is directed toward a second stage 38, one or both of the first and second stages 32, 38 (see FIG. 2) may include impellers with shrouds selectively moveable between an engaged position and a disengaged position in some embodiments.

Various control systems 52 (shown schematically) may be utilized to control the selective movement of the moveable shroud(s) in the disclosed embodiments. In some embodiments, these control systems 52 may include one or more of controller(s), sensor(s), and actuator(s).

Figure 7:
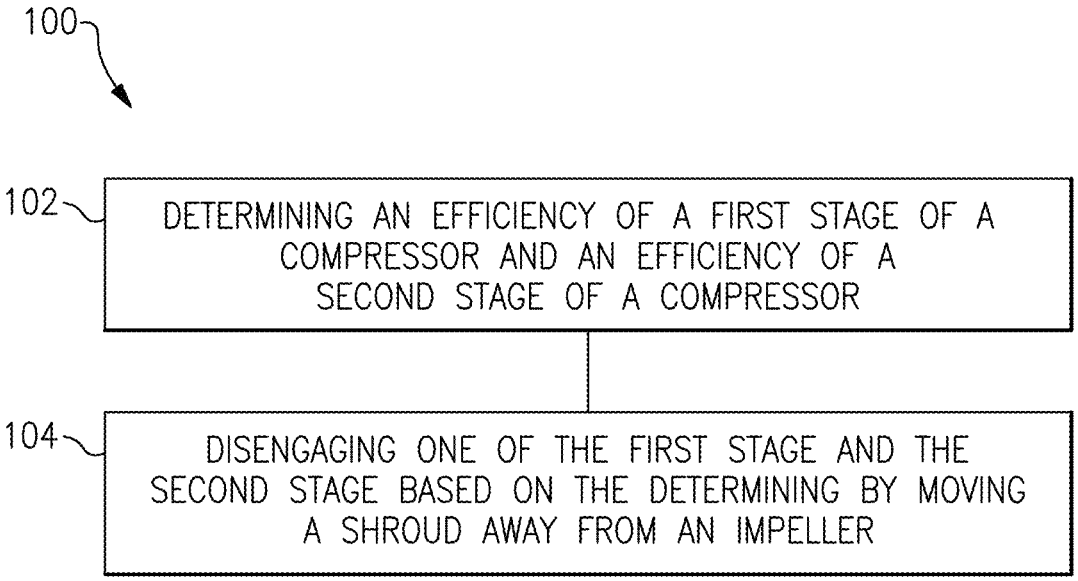
FIG. 7 schematically illustrates a flowchart of an example method of compressing a refrigerant in a centrifugal compressor

FIG. 7 schematically illustrates a flowchart of an example method 100 of compressing a refrigerant in a centrifugal compressor, such as in the examples of this disclosure. At 102, the method 100 includes determining an efficiency of a first stage of a compressor and an efficiency of a second stage of a compressor. At 104, the method 100 includes disengaging one of the first stage and the second stage based on the determining by moving a shroud away from an impeller.

Having a shroud selectively moveable between an engaged position and a disengaged position allows a stage to be disengaged at specific operating points when doing so would result in better efficiency of the compressor.

It should be understood that although a particular component arrangement is disclosed and illustrated in these exemplary embodiments, other arrangements could also benefit from the teachings of this disclosure.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims.

Although the different examples are illustrated as having specific components, the examples of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A centrifugal compressor, comprising:

a first stage having a first input speed;

a second stage having a second input speed that is the same as the first input speed; and a control system configured to determine an overall efficiency of the compressor, to determine a predicted second overall efficiency of the compressor if one of the first stage and the second stage were in a disengaged position, and to move the one of the first stage and the second stage to the disengaged position if the predicted second overall efficiency is greater than the overall efficiency, wherein the one of the first stage and the second stage includes an impeller and a shroud spaced from the impeller and configured to guide a fluid flow through the impeller, wherein the shroud is selectively moveable between an engaged position and the disengaged position.

2. The centrifugal compressor as recited in claim 1, wherein the impeller is rotatable about an axis, and the shroud is selectively moveable in the axial direction relative to the axis between the engaged position and the disengaged position.

3. The centrifugal compressor as recited in claim 1, wherein the impeller is rotatable about an axis, and the shroud is selectively moveable in the radial direction relative to the axis between the engaged position and the disengaged position.

4. The centrifugal compressor as recited in claim 1, wherein the outer surface of the shroud forms a convex surface.

5. A method of compressing a refrigerant in a centrifugal compressor, the method comprising:

determining an efficiency of a first stage of a compressor and an efficiency of a second stage of a compressor, wherein the first stage and the second stage have energy input at a same operating speed;

determining an overall efficiency of the compressor;

determining a predicted second overall efficiency of the compressor if one of the first and second stages were disengaged; and disengaging the one of the first stage and the second stage by moving a shroud away from an impeller if the predicted second overall efficiency is greater than the first overall efficiency.

6. The method as recited in claim 5, wherein the centrifugal compressor is a multi-stage centrifugal compressor.

7. The method as recited in claim 5, wherein the impeller is rotatable about an axis, and the disengaging includes moving the shroud in an axial direction relative to the axis.

8. The method as recited in claim 7, the method further comprising:

engaging the one of the first stage and the second stage based on the determining by moving the shroud in a second axial direction opposite the axial direction.

9. A refrigerant cooling system, comprising:

a main refrigerant loop in communication with a compressor, a condenser, an evaporator, and an expansion device;

the compressor comprising a first stage having a first input speed;

a second stage having a second input speed that is the same as the first input speed; and a control system configured to determine an overall efficiency of the compressor, to determine a predicted second overall efficiency of the compressor if one of the first stage and the second stage were in a disengaged position, and to move the one of the first stage and the second stage to the disengaged position if the predicted second overall efficiency is greater than the overall efficiency, wherein the one of the first stage and the second stage includes an impeller and a shroud spaced from the impeller and configured to guide a fluid flow through the impeller, wherein the shroud is selectively moveable between an engaged position and the disengaged position.

10. The refrigerant cooling system as recited in claim 9, wherein the impeller is rotatable about an axis, and the shroud is selectively moveable in the axial direction relative to the axis between the engaged position and the disengaged position.

11. The refrigerant cooling system as recited in claim 9, wherein the outer surface of the shroud forms a convex surface.

12. The method as recited in claim 5, wherein the impeller is rotatable about an axis, and the disengaging step includes moving the shroud in the radial direction relative to the axis.

13. The method as recited in claim 12, wherein the disengaging step includes moving the shroud from an engaged position to a disengaged position, there is a gap between radially outer edges of blades of the impeller and the shroud, and the disengaging step increases the gap from 0-2 mm in the engaged position to 2-50 mm in the disengaged position.

14. The method as recited in claim 5, wherein the disengaging step includes moving the shroud from an engaged position to a disengaged position, there is a gap between radially outer edges of blades of the impeller and the shroud, and the disengaging step increases the gap from between 0-2 mm in the engaged position to between 2-50 mm in the disengaged position.

15. The compressor as recited in claim 1, wherein there is a gap between radially outer edges of blades of the impeller and the shroud, the gap being between 0-2 mm in the engaged position and between 2-50 mm in the disengaged position.

16. The compressor as recited in claim 3, wherein there is a gap between radially outer edges of blades of the impeller and the shroud, the gap being between 0-2 mm in the engaged position and between 2-50 mm in the disengaged position.

17. The system as recited in claim 9, wherein the impeller is rotatable about an axis, and the shroud is selectively moveable in the radial direction relative to the axis between the engaged position and the disengaged position.

18. The system as recited in claim 9, wherein there is a gap between radially outer edges of blades of the impeller and the shroud, the gap being between 0-2 mm in the engaged position and between 2-50 mm in the disengaged position.

* * * * *